US005109911A

United States Patent [19]

Bockisch

[11] Patent Number: 5,109,911

[45] Date of Patent: May 5, 1992

[54] ACCORDION DOOR

[76] Inventor: Karlheinz Bockisch, Engelbosteler Damm 116-126, 3000 Hannover 1, Fed. Rep. of Germany

[21] Appl. No.: 734,894

[22] Filed: Jul. 24, 1991

[30] Foreign Application Priority Data

Jul. 24, 1990 [DE] Fed. Rep. of Germany ..... 4023440
May 13, 1991 [DE] Fed. Rep. of Germany ... 9105891[U]

[51] Int. Cl.[5] ..... E05D 15/26
[52] U.S. Cl. ..... 160/199; 16/74
[58] Field of Search ..... 160/199, 196.1, 201, 160/206, 209, 40; 16/72, 74, 78

[56] References Cited

U.S. PATENT DOCUMENTS 2,709,274 5/1955 Jorgenson ..... 16/72
3,335,784 8/1967 Risk et al. ..... 160/206 X
3,389,741 6/1968 Bean ..... 160/206 X
3,532,153 10/1970 D'Anka ..... 160/201
3,672,424 6/1972 Brown ..... 160/199 X
3,928,889 12/1975 Wartian ..... 16/74
4,569,164 2/1986 Dickson ..... 160/196.1 X
4,987,638 1/1991 Ribaudo ..... 160/196.1 X
5,036,953 8/1991 Munz ..... 160/196.1 X

*Primary Examiner*—David M. Purol
*Attorney, Agent, or Firm*—Robert W. Becker & Associates

[57] ABSTRACT

An accordion door that is suspended from a horizontal rail. The door comprises individual sections that are each pivotable about a vertical axis that is centrally disposed relative to a width dimension of that section. The sections essentially comprise an expanded plastic core that is provided with panels on opposite sides.

12 Claims, 1 Drawing Sheet

ACCORDION DOOR

BACKGROUND OF THE INVENTION

The present invention relates to an accordion or fold-together door that is suspended from a horizontal rail, with the sections of the door being pivotable about a vertical axis to fold the door together and to open the same.

With heretofore known accordion doors of this type, the pivot axes of the sections essentially coincide with the side edges or folding axes of the sections. As a result of such an arrangement, especially to open the door specific, relatively great inertial forces have to be overcome; the sections must in their entirety be moved out of a plane that is defined by the closed door.

It is therefore an object of the present invention to improve an accordion door of the aforementioned general type in such a way that the door can be rapidly opened and closed with slight drive forces; thus, it is an object of this invention to provide a high-speed door.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
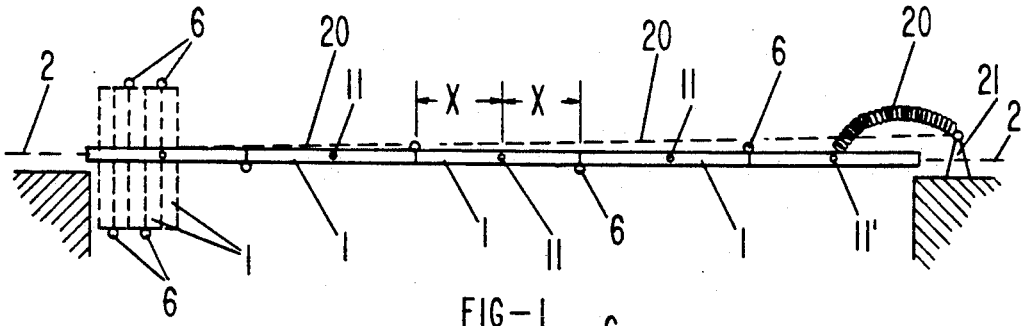
FIG. 1 is a plan view of one exemplary embodiment of the inventive accordion door, with the closed state being shown in solid lines and the opened state being shown in dashed lines.
Figure 2:
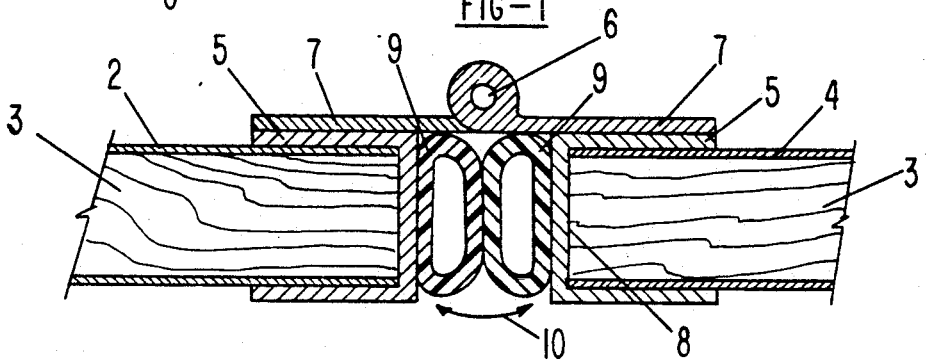
FIG. 2 is a top view of one hinge location where two adjacent sections of the accordion door are connected.
Figure 3:
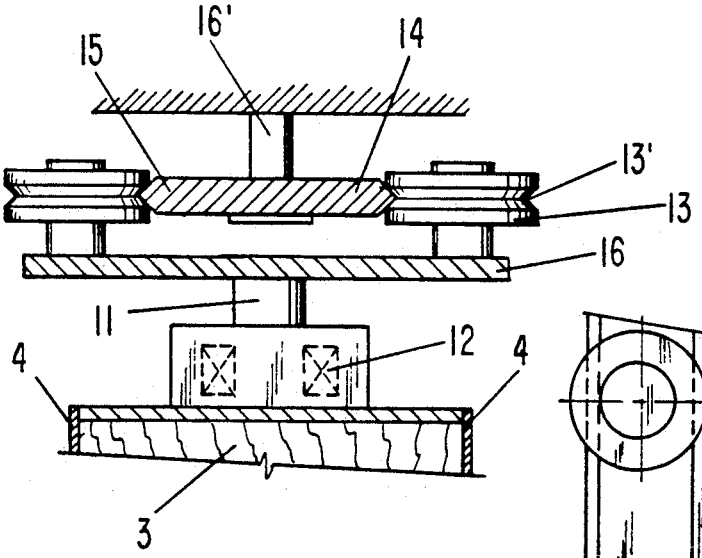
FIG. 3 is a partial, vertical, cross-sectional view through one section of the door in the vicinity of where it is suspended on a horizontal sealing rail.
Figure 4:
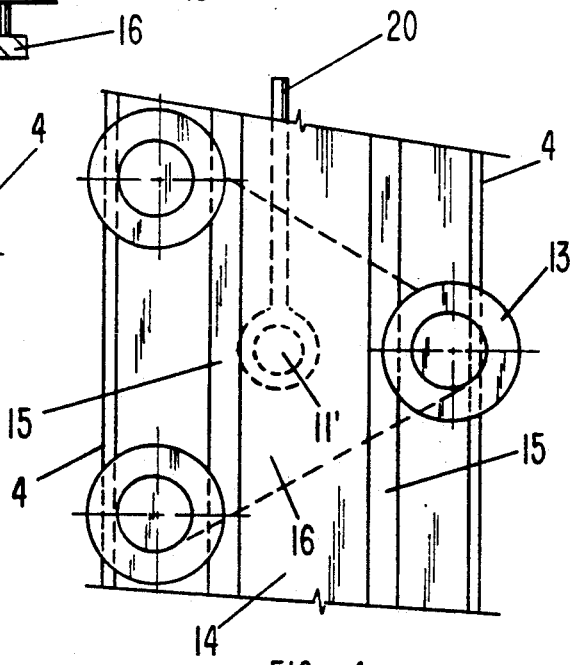
FIG. 4 is a plan view of the section of FIG. 3 in the vicinity of where it is suspended.

The accordion door of the present invention is characterized primarily in that the individual sections thereof are each pivotable about a vertical axis that is centrally disposed relative to a width dimension of that section, with the sections essentially comprising an expanded plastic core that is provided with panels on opposite sides.

One advantage of the present invention is that by supporting the sections in this manner, especially to open the door only slight inertial forces have to be overcome; this effect is enhanced even further by the aforementioned manner of constructing the sections. Although the sections are resistant to bending, they are lightweight. It is therefore possible to use small drive motors to open and close the door relatively rapidly.

The process of opening the door can be speeded up even more by providing compression springs between adjacent sections; these springs are tensioned in the closed state of the door and via an expansion, i.e. a release of tension, overcome east the initial breakaway forces of the door. During closing of the door, these compression springs serve as brakes; during the closing process, the springs are tensioned by the inertial or mass forces that are to be braked, and can contribute to the pivoting of the sections when the door is to be opened.

Further specific features of the present invention will be described in detail subsequently.

DESCRIPTION OF PREFERRED EMBODIMENTS

Referring now to the drawing in detail, the sections 1 of the door have a width that is equal to $2 \times X$. The longitudinal central axis of the sections is indicated by the reference numeral 2. The sections 1 comprise a hard, set, yet specifically light expanded plastic in the form of the core member 3, the front and back sides of which are covered with foil or sheet-like panels 4 that are fixed to the core members 3. The panels 4 can be made of aluminum, or could also be made of a suitable plastic. U-shaped profiled members 5 are disposed at the ends of the sections 1 to encase the same.

Adjacent sections 1 are connected to one another via hinge members 7 and pins 6 that are offset relative to the longitudinal central axis 2, i.e. are eccentrically disposed. In particular, successive joint pins 6 are disposed on alternate sides in order to allow the sections 1 to fold together in a known manner, as indicated by the dashed lines in FIG. 1. Secured to facing surfaces 8 of the profile members 5 are hollow profiled rubber members 9 that in the non-deformed state, with the door folded together, are significantly bulged out; when the operating position has been achieved, i.e. when the door is closed, the profiled rubber members 9 are significantly preloaded in order in this manner to store energy, for example in the manner of a spring. As a consequence of the eccentricity of the joint pins 6, the profiled rubber members 9 try to urge the two sections 1 apart in the direction of the double arrow 10.

On the top, in the middle, in other words at the half-width X, the sections 1 are held by a vertical pin or bolt 11 that lies in the longitudinal central axis 2. The support is effected by the indicated ball bearing means 12. Thus, each section 1 is pivotable about a vertical axis that is defined by the pin 11. Each pin 11 is secured on the underside of a horizontal support member 16 that on the upper side is provided with three guide rollers 13 that are disposed at the corners of a equilateral triangle. The rotating circumferential grooves 13' of the guide rollers 13 engage a horizontal guide rail 14, and in particular engage in the lateral pointed or tapered edges or sides 15 of this guide rail 14. The guide rail 14, in turn, is secured to the ceiling via support bolts 16'.

Pivoting and moving of the sections 1 is effected by lever action against one of the sections 1 via, for example, an electric motor. It is to be understood that other drive and pivot possibilities for the sections 1 would also be appropriate. This pivoting, assisted by the aforementioned spring means in the form of the profiled rubber members 9, is effected nearly instantaneously; due to the aforementioned construction, the sections 1 are lightweight. In addition, a rapid pivoting can be accomplished because the pivoting action occurs about the aforementioned axes of the pins 11.

Due to the hinged connection of all of the sections 1, pivoting or movement of one section 1 leads to an opening or closing movement of the door. Since the guidance of the sections 1 is very precise and is effected without twisting or tilting due to the presence of the support member 16 with the three guide rollers 13, it is not necessary to have any guide or support means at the bottom of the sections 1. Thus, the sections 1 are guided and supported only at their upper ends with the aid of the pins 11.

To speed up the process of closing the door even more, a tension spring 20 is provided that is made of rubber or some other self-damping elastomer. One end of the spring 20, which in the tensioned state extends essentially parallel to the guide rail 14, is secured to the side of the door opening, for example via a small bracket 21 or by being secured to one of the support bolts 16'. The other end of the tension spring 20 is connected to the front of the support member or to the front section that faces the bracket 21, for example to the pertaining pin 11' thereof. The size of the tension spring 20 is such that in the opened state of the door, the length of the spring is approximately 1.5 to 3 times its length when not stretched. If now under these conditions the door is closed by turning on the drive motor and pivoting the sections 1, the tension spring 20 enhances the closing movement because the spring acts upon the support member or the forward section 1. As the closing movement continues, the tension spring 20 relaxes. When the door is closed, the tension spring 20 can hang freely behind the door or can be held by a ring or the like.

As the door is opened, the tension spring 20 is increasingly tensioned, with the spring acting in a dampening manner to prevent a severe impact when the sections 1 finally become completely stacked together.

It would also be possible to dispose the bracket 21 further from the door opening so that the tension spring 20 does not sag too much when the door is opened.

To indicate both states of the tension spring 20, in FIG. 1 the spring 20 is indicated by dashed lines in the tension state, and by dotted lines in the relaxed state.

The present invention is, of course, in no way restricted to the specific disclosure of the specification and drawing, but also encompasses any modifications within the scope of the appended claims.

What I claim is:

1. An accordion door that is suspended from a horizontal rail, comprising:

individual sections that are each pivotable about a respective vertical axis that is centrally disposed relative to a width dimension of said section, with each of said vertical pivot axes being in the form of a pin that is mounted on said section and is also mounted on a horizontal support member that on a side thereon remote from said pin has three guide rollers, two on one side of said rail and the third on the other side of said rail, with each of said guide rollers having a vertical axis of rotation, wherein said vertical axes of rotation of said guide rollers are disposed in the corners of an imaginary triangle, with said rail being a guide rail having longitudinal sides that are tapered and engage with complimentarily shaped outer peripheries of said guide rollers, and with each of said sections essentially comprising an expanded plastic core that is provided with panels on opposite sides.

2. An accordion door according to claim 1, which includes respective eccentrically disposed folding axes for hinge means that connect adjacent ones of said sections; and which includes compression spring means that are disposed between adjacent ones of said sections and are tensioned in a closed state of said door.

3. An accordion door according to claim 2, in which said compression spring means comprise profiled sealing members made of elastomeric material.

4. An accordion door according to claim 3, in which said profiled sealing members are hollow profiled members.

5. An accordion door according to claim 1, in which said vertical pivot axes are also centrally disposed relative to a thickness of said sections.

6. An accordion door according to claim 1, which includes tension spring that in a tensioned state extends essentially in the direction of said rail, with one end of said tension spring being connected to a fixed point, and with another end of said tension spring being connected to support means for said sections; in an open state of said door, said tension spring is tensioned, whereas in a closed state of said door said tension spring is relaxed.

7. An accordion door according to claim 6, in which said tension spring is made of a self-damping material.

8. An accordion door according to claim 7, in which said tension spring is made of an elastomeric material.

9. An accordion door according to claim 6, in which in said tensioned state the length of said tension spring is 1.5 to 3.0 times its length in said relaxed state thereof.

10. An accordion door according to claim 6, in which said another end of said tension spring is connected to a support bolt for said rail.

11. An accordion door according to claim 6, in which said another end of said tension spring is connected to support means disposed on that one of said sections that is disposed the closest to said fixed point for said one end of said tension spring.

12. An accordion door according to claim 6, in which said another end of said tension spring is connected to a pivot pin for that one of said sections that is disposed the closest to said fixed point for said one end of said tension spring.

* * * * *